US007033262B2

(12) United States Patent
Takizawa et al.

(10) Patent No.: US 7,033,262 B2
(45) Date of Patent: Apr. 25, 2006

(54) ABRASIVE SUBSTRATE FOR CARRY TYPE ABRASIVE MACHINE

(75) Inventors: Toshiaki Takizawa, Toyama (JP); Yoshinobu Takahashi, Toyama (JP)

(73) Assignee: YKK Corporation, Tokyo (JP)

( * ) Notice: Subject to any disclaimer, the term of this patent is extended or adjusted under 35 U.S.C. 154(b) by 206 days.

(21) Appl. No.: 10/668,724

(22) Filed: Sep. 22, 2003

(65) Prior Publication Data

US 2004/0127151 A1 Jul. 1, 2004

(30) Foreign Application Priority Data

Oct. 11, 2002 (JP) ..... P. 2002-299386

(51) Int. Cl.
*B24D 17/00* (2006.01)

(52) U.S. Cl. ..... 451/490; 451/359

(58) Field of Classification Search ..... 451/359, 451/490, 495, 514, 515, 511, 512, 525, 360
See application file for complete search history.

(56) References Cited

U.S. PATENT DOCUMENTS

| | | | | |
|---|---|---|---|---|
| 1,778,470 A | | 10/1930 | Stratford | |
| 4,138,804 A | * | 2/1979 | Thielen | 451/342 |
| 4,322,920 A | * | 4/1982 | Wells | 451/342 |
| 4,653,236 A | * | 3/1987 | Grimes et al. | 451/533 |
| 5,201,785 A | * | 4/1993 | Nagano | 451/508 |
| 5,297,366 A | * | 3/1994 | Huddleston | 451/525 |
| 6,634,937 B1 | * | 10/2003 | Edwards et al. | 451/502 |

FOREIGN PATENT DOCUMENTS

| | | |
|---|---|---|
| CA | 960 868 | 1/1975 |
| JP | 63-196223 | 12/1988 |
| JP | 64-23221 | 2/1989 |
| JP | 2585880 | 9/1998 |
| WO | WO 93/08955 | 5/1993 |

* cited by examiner

*Primary Examiner*—Dung Van Nguyen
(74) *Attorney, Agent, or Firm*—Everest Intellectual Property Law Group; Michael S. Leonard

(57) ABSTRACT

An abrasive substrate is removably provided between a head portion and an abrasive member in a carry type abrasive machine. The abrasive substrate is constituted by a single synthetic resin molded member formed of the same material, and a hardness in a peripheral portion is set to be lower than that in a central portion excluding the peripheral edge portion. A difference in the hardness between the central portion and the peripheral portion is regulated by a concavo-convex surface formed on a surface at the fixing side to the head portion of the carry type abrasive machine. It is desirable that the concavo-convex surface should be constituted by a plurality of rib-shaped projections formed on the same plane. The abrasive substrate of the carry type abrasive machine can be manufactured inexpensively and can carry out a reliable and stable abrasion work.

15 Claims, 8 Drawing Sheets

ABRASIVE SUBSTRATE FOR CARRY TYPE ABRASIVE MACHINE

BACKGROUND OF THE INVENTION

1. Field of the Invention

The present invention relates to an abrasive substrate provided between a head portion of a carry type abrasive machine which is rotated and vibrated electrically and an abrasive member such as an abrasive paper or an abrasive cloth to be a grinding/abrasive tool, and fixed removably to both the head portion and the abrasive member.

2. Description of the Related Art

In the carry type abrasive machine of this kind, the central part of an abrasive substrate is fixed to a head portion with a bolt and an abrasive member such as an abrasive paper or an abrasive cloth is joined to a surface on the opposite side of a surface on the head side of the abrasive substrate through an adhesive, for example, or is surface joined through a plane fastener (hook and loop fastener) including a male engaging member having a large number of hook-shaped engaging elements and a female engaging member having a loop-shaped engaging element and three of them are integrally fixed. For this reason, the back face of the abrasive member is coated with the adhesive or one of the engaging members of the plain fastener is fixed and the other engaging member of the plain fastener is fixed to the corresponding joined surface of the abrasive substrate.

Usually, the abrasive substrate has such a structure that a rigid doughnut disk-shaped base member and a doughnut disk-shaped elastic plate formed by a sponge are provided integrally and a disk having a large number of hook-shaped, mushroom-shaped, anchor-shaped or conical projections for joining and integrating an abrasive member are further fixed to a surface on the external exposure side of the elastic plate with an adhesive as disclosed in JP-UM(Utility Model)-A-63-196223 and JP-UM-A-64-23221, for example. Alternatively, a rotary disk corresponding to the abrasive substrate is simply constituted by a solid rigid body as disclosed in Japanese Utility Model Registration No. 2585880, for example.

When a carry type abrasive machine is to be operated, a holding portion is usually grasped by one or both hands to push an abrasive member fixed to the surface of a rotating abrasive substrate against a surface to be abraded, thereby carrying out an abrasion work. At this time, generally, the surface to be abraded is not simultaneously abraded with the whole surface of the abrasive member but the abrasion is carried out by moving an abrasive machine to an abraded surface region to be abraded while pushing a partial peripheral edge portion of the abrasive member against the surface to be abraded in respect of the abrasion work in order to uniformly abrade the whole surface to be abraded. More specifically, the abrasive substrate fixing the abrasive member is raised at this side and is inclined forward together with the cary type abrasive machine, thereby performing the abrasion work.

For this reason, in case of an abrasive substrate constituted by a solid rigid body, the shape of an abrasive substrate is used as a conical base and a surface to be abrasive is abraded with a part of an internal or external peripheral surface which is inclined in such a manner that the surface to be abraded can be abraded partially as described in the Japanese Utility Model Registration No. 2585880. Since the abrasive substrate in the abrasive machine is rigid, however, it is elastically deformed with difficulty and a skilled operator can implement the abrasion by uniform pushing force against the surface to be abraded for the first time. On the other hand, the elastic plate described in the JP-UM-A-63-196223 and the JP-UM-A-64-23221 functions as a simple cushion member, and furthermore, has the function of uniformly applying predetermined force through the elastic plate on an abutting surface when the abrasive substrate is inclined obliquely and is pushed against the elastic plate.

JP-UM-A-63-196223, JP-UM-A-64-23221, and Japanese Utility Model Registration No. 2585880 are known as reference documents.

Referring to the structure of the abrasive substrate according to JP-UM-A-63-196223 and JP-UM-A-64-23221, a synthetic resin base member formed of a hard material, an elastic plate formed by a sponge and a hook plate or projection plate are separate members respectively and are to be polymerized and fixed.

For example, in JP-UM-A-63-196223, one side of each of the base member, the elastic plate and the hook plate having a large number of hook-shaped projections is previously joined through an adhesive, and a cup-shaped attachment member is fitted in an attachment hole on a central part and is fastened and fixed with a wood screw through a screw hole formed in the peripheral edge flange portion of the attachment member. The center of the bottom portion of the cup-shaped attachment member is opened to form projections to be indented on the peripheral edge of the opening, a notch is formed in three portions of the circumferential part of the center of a scrubbing brush to be the abrasive member according to the invention, and the indented projections are engaged with the notches of the scrubbing brush for attachment when the scrubbing brush is to be attached to the bottom portion of the cup-shaped attachment member.

According to JP-UM-A-64-23221, moreover, a synthetic resin base member formed of a doughnut disk-shaped hard material, an elastic plate (a sponge plate) having the same shape and a projection plate including a large number of projections having conical diameters on a surface are laminated and integrated through joining, and a scrubbing brush is joined and integrated onto the exposed surface of the projection plate through a removable projection plate. For this reason, a plurality of window portions are formed on the projection plate and the removable projection plates are fitted in the window portions. A large number of male engaging elements of a plain hook and loop fastener are formed on both sides of the removable projection plate. When the removable projection plate is fitted in the window portion of the projection plate, the male engaging element is engaged with and joined to the elastic plate which is exposed to the window portion and the conical projection formed on the surface of the projection plate and the male engaging element formed on the surface of the removable projection plate are engaged and joined to each other in the scrubbing brush attached to the exposed surface of the projection plate.

Thus, the abrasive substrates according to JP-UM-A-63-196223 and JP-UM-A-64-23221 are constituted by a plurality of members. In addition to the manufacture and processing of each member, therefore, the respective members are to be laminated and joined or another member is to be joined in the assembly of the base member. Correspondingly, various costs required for the process are added so that the whole abrasive substrate becomes expensive and an economical burden is imposed.

SUMMARY OF THE INVENTION

The invention has been made in order to solve the problems. An object of the invention is to provide an abrasive substrate of a carry type abrasive machine which has a simple structure, can be manufactured inexpensively and can carry out a reliable and stable abrasion work.

The object can be attained by an abrasive substrate for a carry type abrasive machine which is provided removably between a head portion and an abrasive member of the carry type abrasive machine which is a basic structure of the invention, wherein the abrasive substrate is constituted by a single synthetic resin molded member formed of the same material, and a hardness in a peripheral portion of the abrasive substrate is lower than a hardness in a central portion excluding the peripheral portion.

First of all, the abrasive substrate according to the invention is characterized in that it is an integral molded product formed by a single molding material. More specifically, the abrasive substrate is formed to have a predetermined shape by one-time injection molding, for example. Accordingly, the feature that the hardness in the peripheral portion is set to be lower than that in the central portion excluding the peripheral edge portion is produced by the structure of the molded product. The bending structure becomes slightly expensive in respect of economy. However, a manufacturing process and an assembling process can be omitted as compared with the related art. Consequently, it is possible to employ various advantageous structures. For example, it is also possible to cause the peripheral portion and the central portion of the abrasive substrate to have a difference in a hardness by making the thickness of the central portion of the abrasive substrate greater than that of the peripheral portion.

According to the invention, the difference in a hardness is made between the peripheral portion and the central portion of the abrasive substrate. Consequently, when the abrasive substrate is to be attached to an ordinary carry type abrasive machine to perform an abrasion work, an abrasive paper cloth to be an abrasive member is deformed in conformity with the elastic deformation of the peripheral portion of the abrasive substrate and abrasion can be carried out uniformly with high precision along a surface to be abraded even if the carry type abrasive machine is inclined obliquely to perform the work, for example.

When the abrasive substrate is used for a rotating type abrasive machine, the abrasive substrate has the shape of a rotating disk. When the abrasive substrate is used for a vibrating type abrasive machine, the abrasive substrate has the shape of a rectangular or triangular vibrating polygonal plate, for example. Moreover, the abrasion to be used in the invention generally includes polishing in addition to ordinary grinding and abrasion using abrasive grains. Accordingly, the abrasive member also includes an abrasive tool generally referred to as an abrasive paper cloth having a large number of abrasive grains stuck thereto or a buff formed by a so-called nonwoven fabric or felt.

In respect of economy, furthermore, it is preferable that the difference in a hardness between the central portion and the peripheral portion should be regulated by a concavo-convex surface formed on a surface at the fixing side to the head portion of the carry type abrasive machine in place of the difference in a hardness made by the difference in a thickness. Referring to the regulation is to be carried out by the concavo-convex surface, when the thickness of the substrate is uniform, a groove having a small width is formed or is not formed in the central portion, and a groove having a great width is formed in the peripheral portion, and furthermore, a space between the grooves is reduced and the number of the grooves on the peripheral side is increased if the width of the groove is equal. In this case, the sectional shape of the groove is optional, for example, an inverted triangle or a rectangular U-shape.

In respect of the manufacture of a metal mold and the strength of the base member, the most preferable structure of the concavo-convex surface has a plurality of rib-shaped projections formed on the same plane. In addition, it is desirable that the rib-shaped projections should be extended like a radial straight line or curved line from a support center portion toward the periphery by the head portion of the carry type abrasive machine, and furthermore, the rib-shaped projections may be formed in a multistage from the support center portion toward the periphery. More specifically, the rib-shaped projections can be formed intermittently in a radial direction. In this case, if a gap between the adjacent rib-shaped projections is reduced in the central portion and is increased in the peripheral portion, the flexibility of the peripheral portion can easily be obtained. In the case that the rib-shaped projections are to be provided intermittently from the central portion toward the periphery, moreover, the abrasive substrate body can be bent more easily between the adjacent rib-shaped projections in the direction of the extension so that the bending portion can be specified, which is preferable.

Moreover, the rib-shaped projections can also be formed like a ring extended along a plurality of concentric circumferences around the support center by the head portion of the carry type abrasive machine. When the ring-like rib-shaped projection is thus formed, the well-balanced smooth rotation of the abrasive substrate can be obtained by the rotating type abrasive machine, for example, and a strength in a circumferential direction can be further maintained. In particular, in the rotating type abrasive machine, accordingly, it is preferable that the rib-shaped projections extended radially should be formed in addition to the ring-like rib-shaped projection.

In the abrasive substrate of this kind, usually, abrasive wastes are sucked into the abrasive machine body and are collected into a dust collecting container. For this reason, a plurality of dust sucking holes are formed in a circumferential direction in the body portion of the abrasive substrate. If the ring-like rib-shaped projections are formed to couple the dust sucking holes, and furthermore, the rib-shaped projections extended radially from the central portion are continuously formed up to the dust sucking holes and a plurality of straight or curved rib-shaped projections extended to the outside diameter side are formed in a predetermined gap from the ring-like rib-shaped projections, the abrasive substrate is apt to be deformed elastically on the outside of the ring-like rib-shaped projections, and at the same time, a predetermined strength can be maintained on the inside and outside diameter sides interposing the ring-like rib-shaped projections therebetween, which is preferable.

It is also possible to obtain the difference in a hardness by setting the height of the rib-shaped projection in the peripheral portion to be smaller than that of the rib-shaped projection in the central portion. Even if the concavo-convex surface is formed by a large number of projections having different sizes which are molded over the same plane in place of the rib-shaped projections, furthermore, the difference in a hardness can be given between the central portion and the peripheral portion. For example, if the projection has a hemispherical shape, it is preferable that the diameter of the projection in the central portion should be increased and an arrangement space should be reduced, and the diameter of the projection in the peripheral portion should be reduced and an arrangement space should be increased. In this case, an array is optional and a zigzag array in a circumferential direction is preferable.

In the invention comprising the attachment structure to be attached to the driving head portion of the carry type abrasive machine in the central part of the abrasive substrate in the same manner as in the related art, in the case that the abrasive substrate and the abrasive member are fixed by utilizing the joining mechanism of a plain fastener (hook and loop fastener), it is preferable that a large number of male engaging elements which can be joined to and removed from the abrasive member should be formed integrally with the abrasive substrate over the fixed surface of the same substrate. For the conventional attachment of the male engaging member of the plain fastener, the male engaging member is fabricated separately from the substrate and is fixed to the surface of the substrate by joining. In the case that the integral formation is carried out simultaneously with the formation of the substrate, it is possible to avoid the complexity of the manufacture and the increase in a cost.

On the other hand, in this case, it is necessary to form a nonwoven fabric or a woven fabric having a loop-shaped female engaging element on the fixing surface of an abrasive member such as an abrasive cloth paper to the abrasive substrate. In the case that the abrasive substrate and the abrasive member are fixed by utilizing a joining mechanism with an adhesive, moreover, a predetermined adhesion strength can be obtained if the fixing surface of the substrate to the abrasive member is to be rough to increase an adhesion area, which is preferable. The rough surface can be formed by carrying out buffing or fine embossing over the back surface of the abrasive member, for example, or by providing a fibrous nonwoven fabric on the back face of the abrasive member to perform press molding with an impregnating resin.

DETAILED DESCRIPTION OF THE PREFERRED EMBODIMENTS

Figure 1:
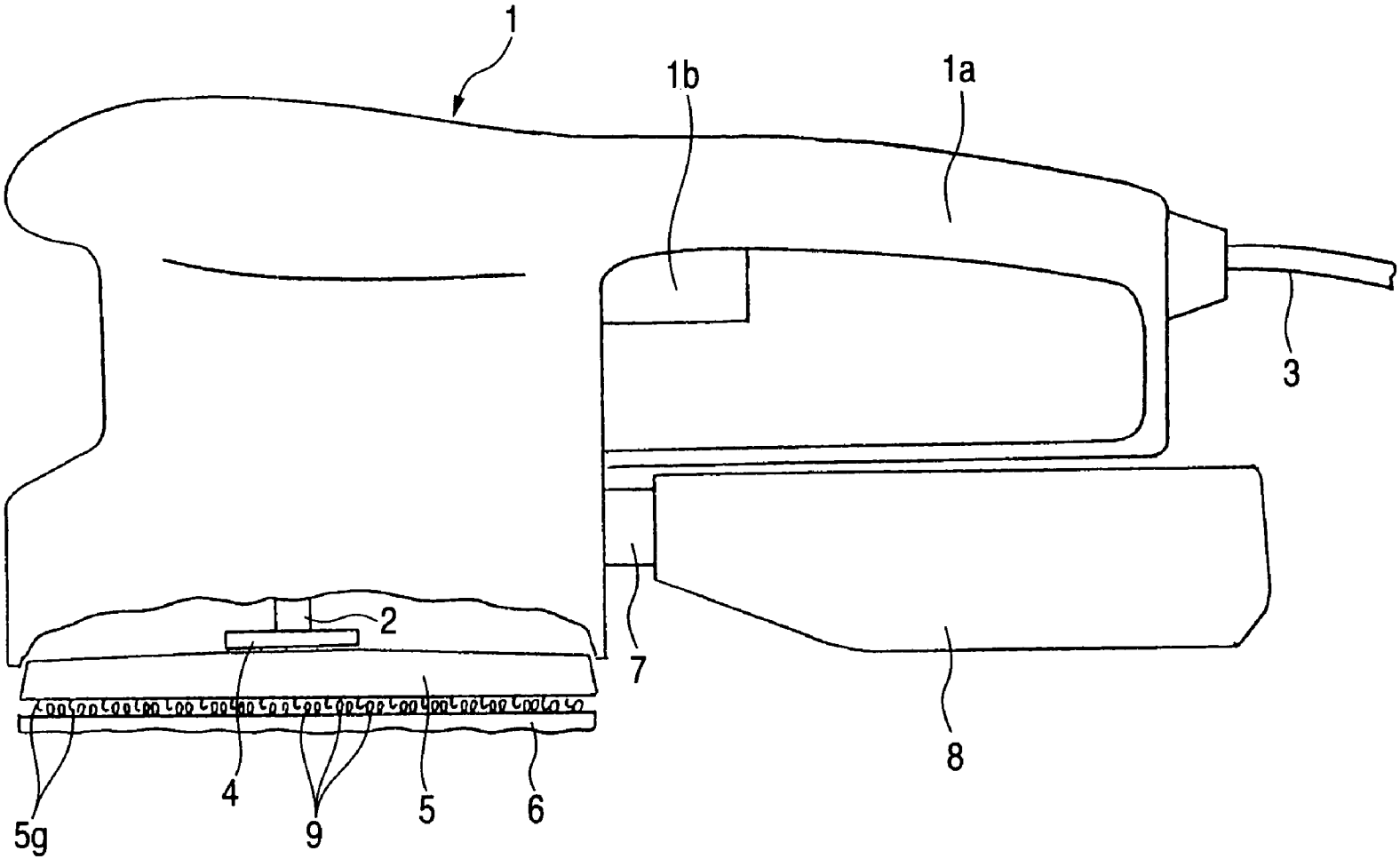
FIG. 1 is a side view showing an example of an appearance of a carry type rotating abrasive machine to which an abrasive substrate according to the invention is applied, which is partially cut out.

A preferred embodiment of the invention will be specifically described below with reference to the drawings. FIG. 1 is a view schematically showing an appearance in which a part of a carry type abrasive machine to which an abrasive substrate according to the invention is applied is cut out. In FIG. 1, reference numeral "1" denotes a abrasive machine body. Reference numeral "2" denotes a main shaft coupled to the output shaft of an electric motor (not shown) which is provided in the abrasive machine body 1 and is connected to an external power source (not shown) through a cord 3. Reference numeral "4" denotes a head portion fixed to the tip of the main shaft 2, and an abrasive substrate 5 according to the invention is fastened to the head portion 4 and an abrasive cloth to be an abrasive member 6 is surface joined removably to a surface on the abrasion side of the abrasive substrate 5. Moreover, a dust collecting container 8 is attached to a side surface on the holding portion 1*a* side of the abrasive machine body 1 through a pipe 7 communicating with the internal space portion of the abrasive machine body 1. Furthermore, a dust collecting blade 2*a* is attached into the position of the main shaft 2 which is opposed to the opening of the pipe 7 and is rotated with the rotation of the main shaft, thereby positively sucking abrasive wastes into the abrasive machine body 1 and collecting the dust into the dust collecting container 8 through the pipe 7.

Figure 2:
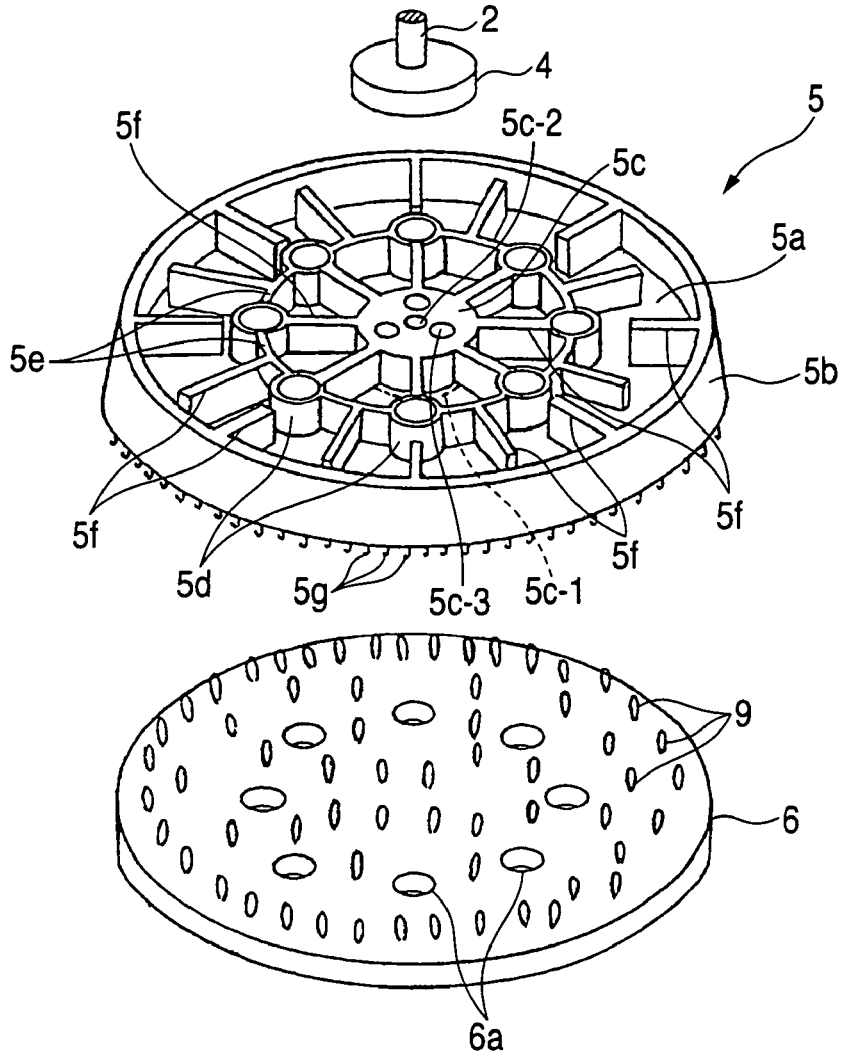
FIG. 2 is an exploded view showing an example of a structure according to a first embodiment of the abrasive substrate of the invention, and the abrasive substrate, the rotating head portion of the abrasive machine and the abrasive member.
Figure 4:
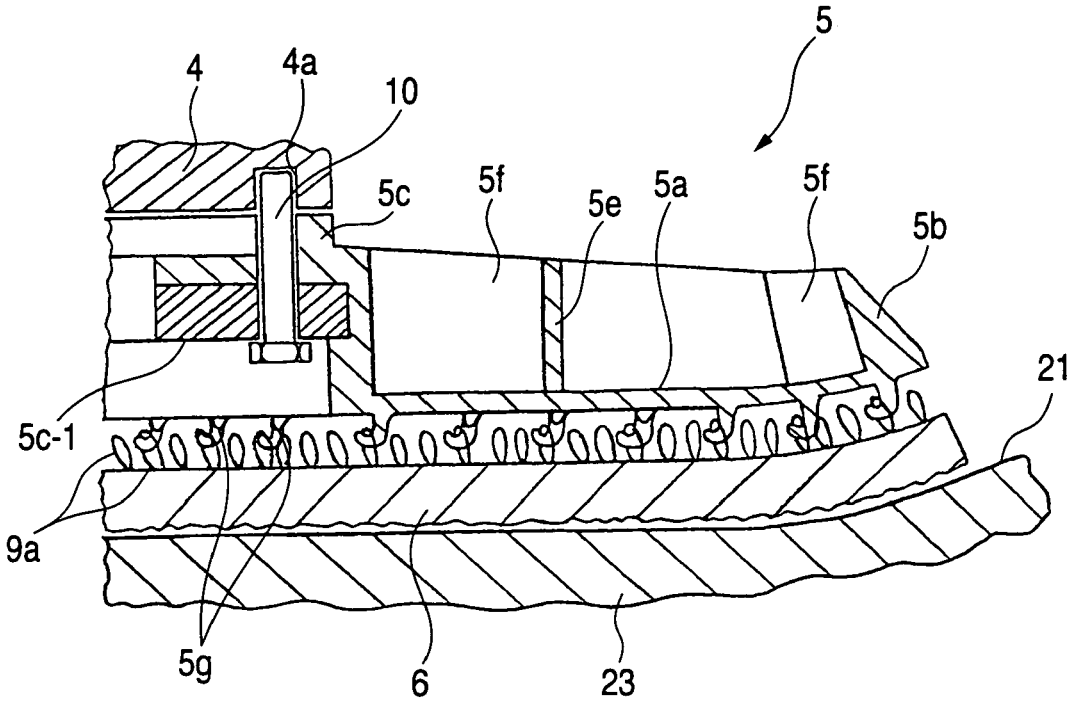
FIG. 4 is a sectional enlarged view partially showing the structure of the assembly portion of the abrasive substrate, the rotating head portion of the abrasive machine and the abrasive member.

FIG. 2 shows the relationship of arrangement of the abrasive substrate 5, the head portion 4 of the abrasive machine body 1 and the abrasive member 6 formed of a buff according to a typical embodiment of the invention. The abrasive substrate 5 according to the embodiment takes the shape of a disk and a carry type abrasive machine is of a rotating type. A disk-shaped member described in an upper part of FIG. 2 indicates the head portion 4 of the abrasive machine, a member described in a middle part indicates the disk-shaped abrasive substrate 5 according to the embodiment, and a member described in a lower part indicates the buff 6 having the same shape as the shape of the abrasive substrate 5. As shown in FIG. 4, a plurality of (three in the example of the drawing) bolt screw holes 4*a* are formed with a phase difference of 120 degrees on the same circumference over the lower surface of the head portion 4. Moreover, a female engaging member 9 of a plane fastener (hook and loop fastener) is fastened to the fixing surface of the abrasive member 6 to the abrasive substrate 5. The body of the abrasive member 6 is provided with a plurality of dust sucking holes 6*a* in positions corresponding to cylindrical projections 5*d* formed on the abrasive substrate 5.

Figure 3:
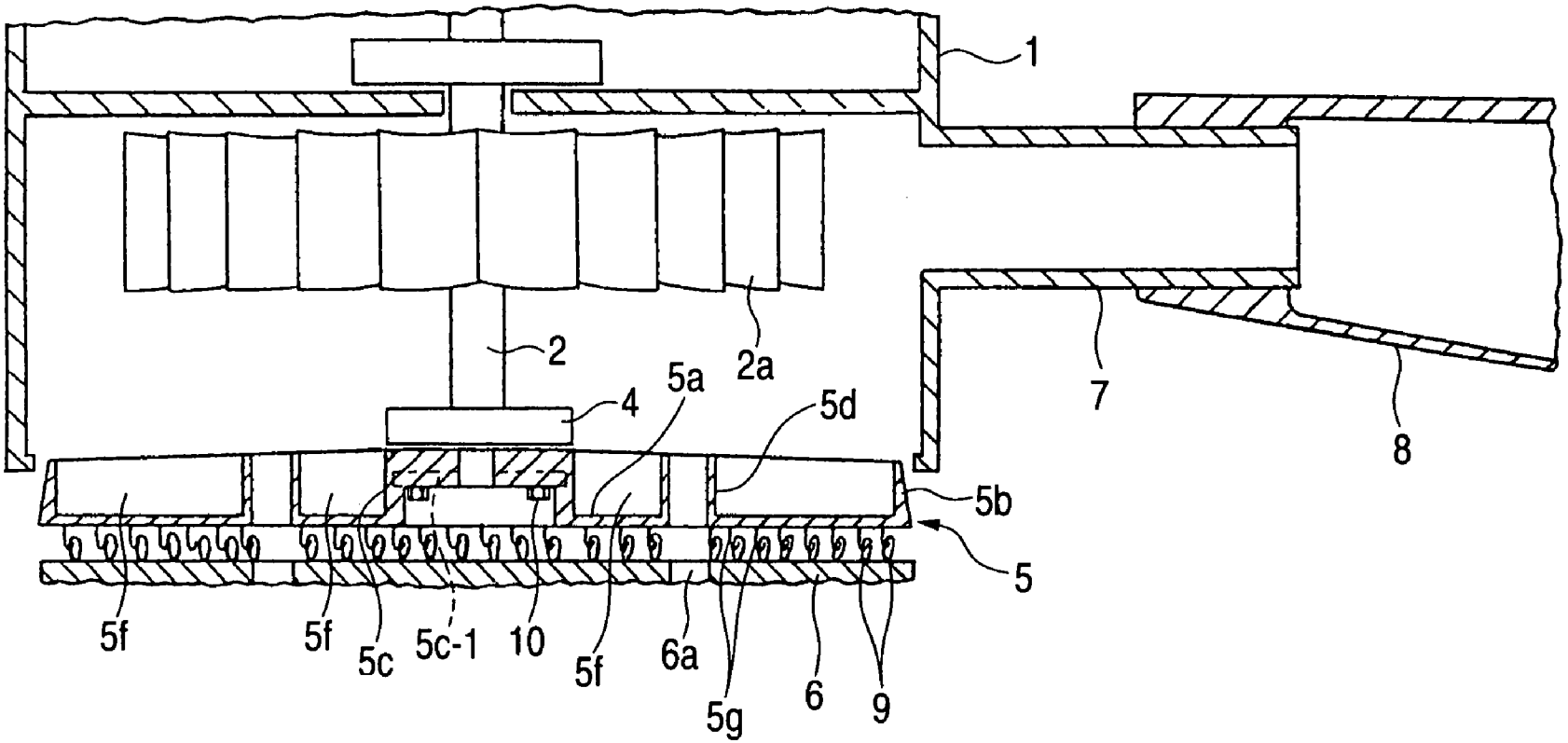
FIG. 3 is a partial sectional enlarged view showing a part of the internal structure of an abrasive machine body to which the abrasive substrate according to the invention is applied.

As shown in FIG. 3, the abrasive substrate 5 according to the embodiment has a ring-shaped vertical wall 5*b* formed continuously along an outer peripheral edge portion on one of sides of a disk 5*a* having a predetermined diameter. Moreover, a shaft portion 5*c* having the same height as the height of the vertical wall 5*b* is protruded from the central part of the disk 5*a*, and eight cylindrical projections 5*d* constituting a dust sucking hole penetrating through the disk 5*a* are provided with a phase difference of 45 degrees on the same circumference in a position of ½ in a radial direction between the shaft portion 5*c* and the vertical wall 5*b*. Furthermore, the cylindrical projections 5*d* are coupled through ring-like rib-shaped projections 5*e* having equal heights on the same circumference in which the cylindrical projections 5*d* are provided.

The shaft portion 5*c* takes the shape of a covered cylinder, and a metallic disk 5*c*-1 is embedded in the cover portion as shown in FIG. 4, a through hole 5*c*-2 is formed in a central part thereof and three bolt insertion holes 5*c*-3 are formed with a phase difference of 120 degrees on the same circumference around the through hole 5*c*-2.

In the abrasive substrate 5 according to the embodiment, moreover, the shaft portion 5*c* protruded from the central part of the disk 5*a* and the cylindrical projection 5*d* are coupled to form a plurality of (eight in the example of the drawing) straight rib-shaped projections 5*f* having an equal height to the height of the projection 5*d*, and furthermore, there are alternately formed eight straight rib-shaped projections 5*f* extended in a central direction with a phase difference of 45 degrees on the internal wall surface of the ring-shaped vertical wall 5*b* and eight straight rib-shaped projections 5*f* extended radially with a phase difference of 45 degrees from the external wall surfaces of the ring-like rib-shaped projections 5*e*. On the other hand, a large number of hook pieces 5*g* of the plain fastener are protruded from an abrasive member fixing surface on the opposite side of the disk 5*a* as shown in FIG. 5.

Figure 5:
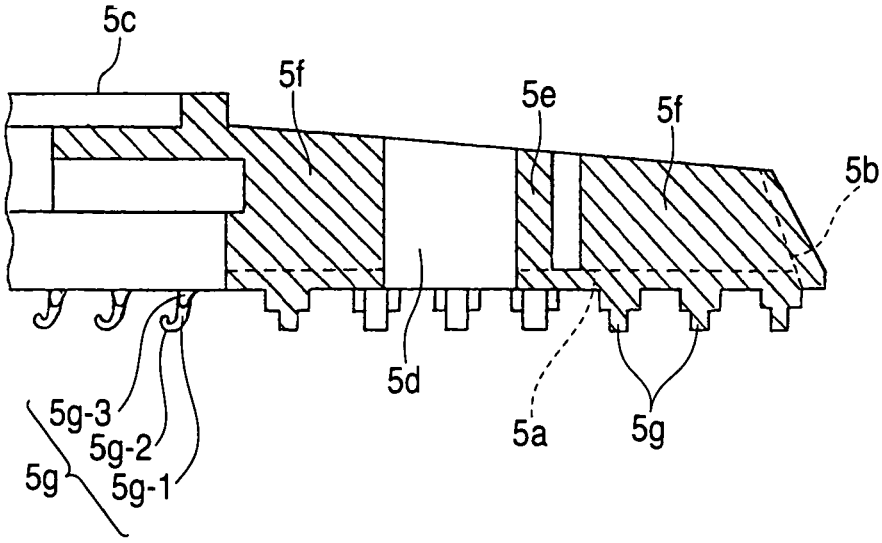
FIG. 5 is a partial sectional view showing an engaging substrate according to an example of the structure of a hook piece to be a male engaging element formed on the abrasive member fixing surface of the abrasive substrate.

As shown in FIG. 5, the hook piece 5*g* is constituted by an erected portion 5*g*-1 erected from the abrasive member fixing surface of the disk 5*a*, an engaging head portion 5*g*-2 extended in one direction from the tip of the erected portion 5*g*-1 and curved like a hook toward the abrasive member fixing surface, and a reinforcing rib 5*g*-3 formed on the left and right side surfaces which is orthogonal to the direction of extension of the head portion of the erected portion 5*g*-1, and is formed integrally with the disk 5*a* in the same metal mold during the formation of the abrasive substrate 5 according to the invention.

Figure 6:
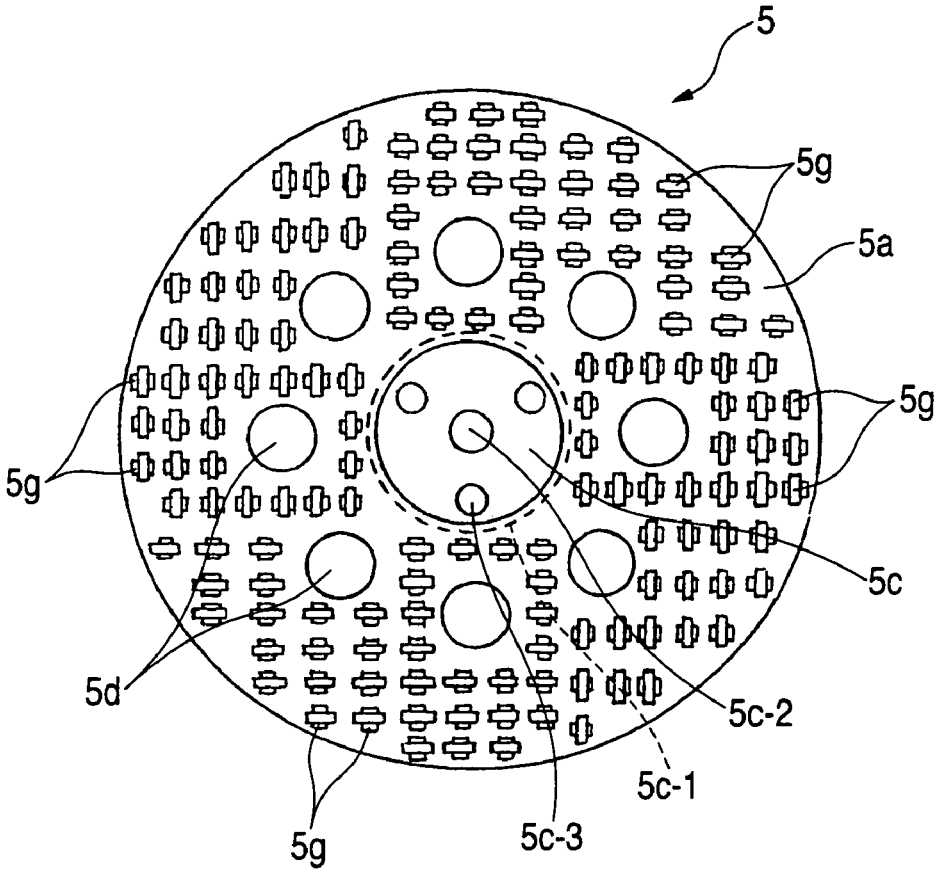
FIG. 6 is a plan view showing an example of the array of the hook piece on the abrasive substrate.

As shown in FIG. 6, the hook pieces 5*g* according to the embodiment are equally divided into four blocks around the shaft portion 5*c* and the direction of extension of the hook for each adjacent block is sequentially inverted by 90 degrees. Consequently, a joining strength to the abrasive member 6 has no directivity, and particularly, suitable joining is carried out between the abrasive substrate 5 according to the embodiment which is rotated and the abrasive member 6.

The abrasive substrate 5 having such a structure is usually formed by injection molding. For the material of the abrasive substrate 5, a thermoplastic resin such as a polyacetal type resin, a polyethylene terephthalate type resin or a polybutylene terephthalate type resin is used.

Referring to the abrasive substrate 5 according to the embodiment, thus, it is possible to manufacture all the components by one-time molding using the same material. Consequently, it is not necessary to carry out a large number of steps, for example, the steps of manufacturing, processing and assembling the components differently from the related art. If manufacturing equipment is once prepared, furthermore, the metal mold is to be exchanged in the change of the type of the abrasive substrate 5 and another special equipment does not need to be exchanged. In addition, the manufacture can be automated without requiring any person's help and mass production can be carried out so that a cost can be reduced considerably.

In order to attach the abrasive substrate 5 according to the embodiment which has the structure above-described to the abrasive machine body 1, as shown in FIG. 4, the bolt screw 4*a* formed in the head portion 4 of the abrasive machine body 1 is put together with the bolt insertion hole 5*c*-3 formed on the shaft portion 5*c* of the abrasive substrate 5 and the abrasive substrate 5 is applied to the head portion 4, and both of them are fixed with a bolt 10. When the attachment is carried out, the female engaging member 9 of the abrasive member 6 is pushed against the abrasive member fixing surface of the abrasive substrate 5 to engage a loop piece 9*a* of the female engaging member 9 with the hook pieces 5*g* which integrally formed with the abrasive member fixing surface and to join them.

When a surface to be abraded 21 of an abraded member 23 is abraded by means of the abrasive machine, the holding portion 1*a* of the abrasive machine body 1 is grasped by one hand to turn on a switch 1*b* so that an electric motor (not shown) is operated and the head portion 4, the abrasive substrate 5 and the abrasive member 6 are driven and rotated together. The rotation is confirmed and the abrasive member 6 is then pushed against the surface to be abraded 21. In order to uniformly abrade the whole of the surface to be abraded 21 at this time, the abrasion is not carried out with the whole surface of the abrasive member 6 but a part thereof is pushed against the surface to be abraded 21 and a pushing position is evenly varied so that the abrasion can uniformly be carried out over the whole of the surface to be abraded 21. For this reason, this side of the abrasive machine body 1 is obliquely held to rise from the surface to be abraded 21 in the abrasion, and the tip portion of the abrasive member 6 is pushed against the surface to be abraded 21. In the abrasive substrate 5 according to the embodiment, the peripheral portion is softer and is elastically deformed more easily than the body side of the central part by the structure. Therefore, the deformation can easily be carried out by the pushing force so that the abrasive member 6 can uniformly act on the surface to be abraded 21.

The abrasion wastes generated during the abrasion work are sucked by the rotation of the dust collecting blade 2*a* attached to the main shaft 2 and are then sucked through a dust passing hole 6*b* formed on the abrasion member 6 and the cylindrical projection 5*d* constituting the dust passing hole formed on the abrasive substrate 5, and are thus collected into the dust collecting container 8 through the pipe 7.

Figure 7:
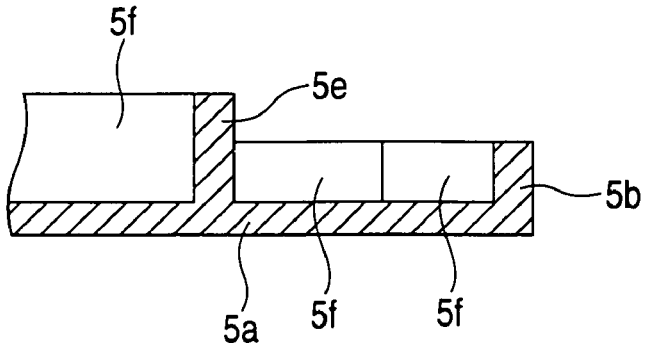
FIG. 7 is a partial sectional view showing a variant of the first embodiment.
Figure 8:
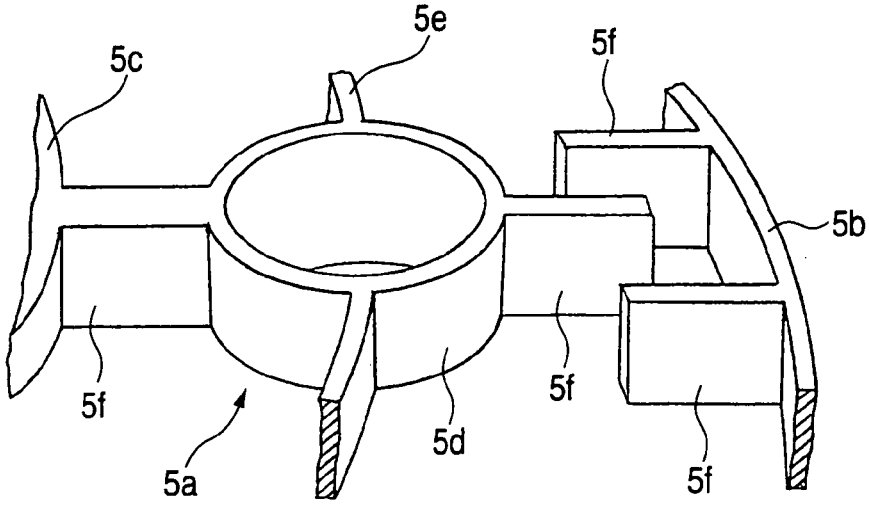
FIG. 8 is a partial sectional view showing another variant of the first embodiment.

In the abrasive substrate 5 according to the embodiment, all the vertical wall 5*b*, the shaft portion 5*c*, the cylindrical projection 5*d*, the straight rib-shaped projection 5*f* and the ring-like rib-shaped projection 5*e* which are formed integrally with the disk 5*a* as described above have equal heights. As shown in FIG. 7, for example, in the shaft portion 5*c*, the cylindrical projection 5*d*, the straight rib-shaped projection 5*f* and the ring-like rib-shaped projection 5*e* which are formed in the central portion, the heights of the straight rib-shaped projection 5*f* and the ring-like rib-shaped projection 5*e* on the cylindrical projection 5*d* and shaft portion 5*c* side are set to be greater than the height of the straight rib-shaped projection 5*f* on the vertical wall 5*b* and outer peripheral side or the projection widths of the straight rib-shaped projection 5*f* and the ring-like rib-shaped projection 5*e* on the shaft portion 5*c* side are set to be greater than the width of the straight rib-shaped projection 5*f* on the vertical wall 5*b* and outer peripheral side as shown in FIG. 8 so that a difference in a hardness can be made between the central portion and the peripheral portion.

Figure 9:
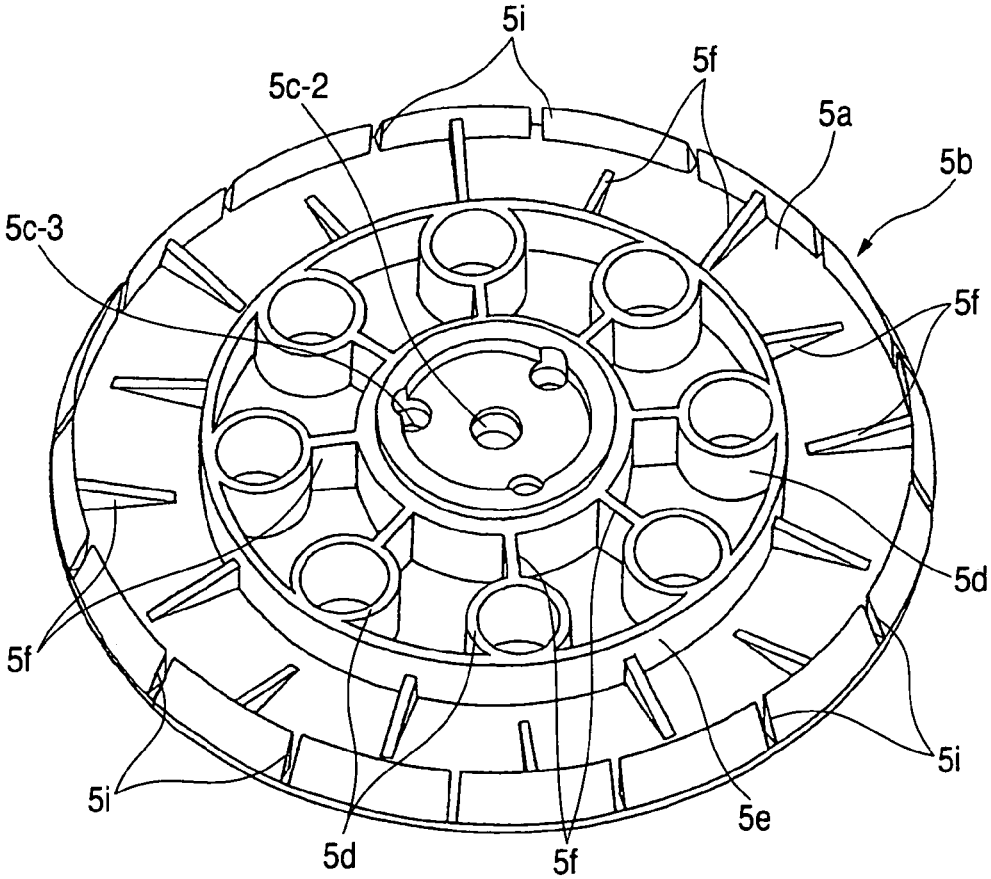
FIG. 9 is a general perspective view showing a second embodiment of the abrasive substrate according to the invention as seen from an upper surface.

FIG. 9 shows a second embodiment of the invention. As shown in FIG. 9, the respective upper surfaces of straight rib-shaped projections 5*f* provided on the outside with the ring-like rib-shaped projections 5*e* in the first embodiment interposed therebetween and extended alternately from the inside and the outside are caused to be taper surfaces inclined downward in the alternate direction, and furthermore, a slit-shaped notch 5*i* cut in a vertical direction is formed between the straight rib-shaped projections 5*f* extended in a central direction from the vertical wall 5*b* formed along the peripheral edge of the disk 5*a*. By such a structure, the inside of the ring-like rib-shaped projection 5*e* to be the central portion of the abrasive substrate 5 has a high hardness and the middle part of the vertical wall 5*b* is easily deformed elastically like a ring in the outer peripheral portion of the rib-shaped projection 5*e*. Consequently, the abrasion work can be carried out reliably.

Figure 10:
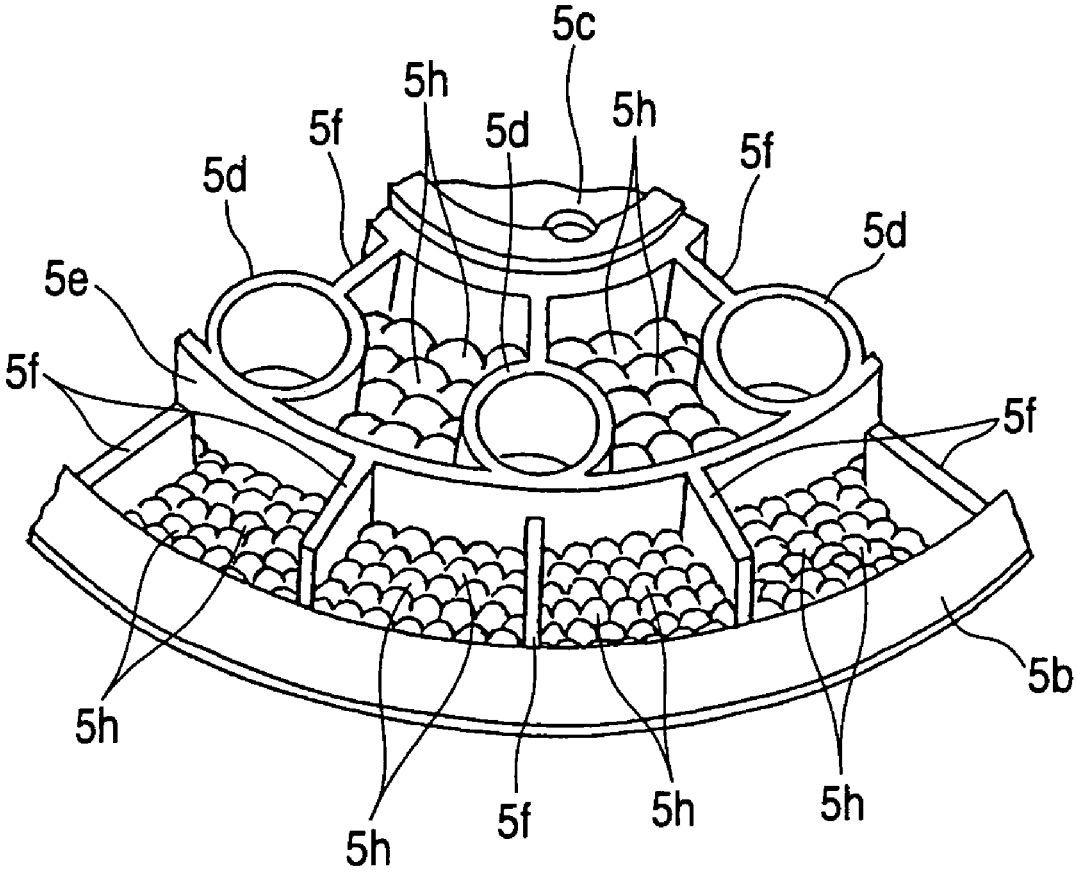
FIG. 10 is a partial perspective view showing a third embodiment of the abrasive substrate according to the invention as seen from an upper surface.

Moreover, in the case that a difference in a hardness between the central portion and the peripheral portion in the abrasive substrate 5 to be formed by using the same metal mold is to be regulated, for example, a large number of molding cavities (not shown) of the straight rib-shaped projections 5*f* are previously formed intermittently in the mold and an insertion mold is inserted in or removed from the cavities so that the regulation can easily be carried out. For a variant of an concavo-convex surface to be formed on the disk 5*a*, it is also possible to make the difference in a hardness between the central portion and the peripheral portion in the abrasive substrate 5 by forming a large number of semispherical or pyramid-shaped projections 5*h* having lengths varied along the disk 5*a* at a base end as shown in FIG. 10, for example. In this case, if the projections 5*h* are properly coupled to each other through the rib-shaped projections, the difference in a hardness can be made optionally.

Figure 11:
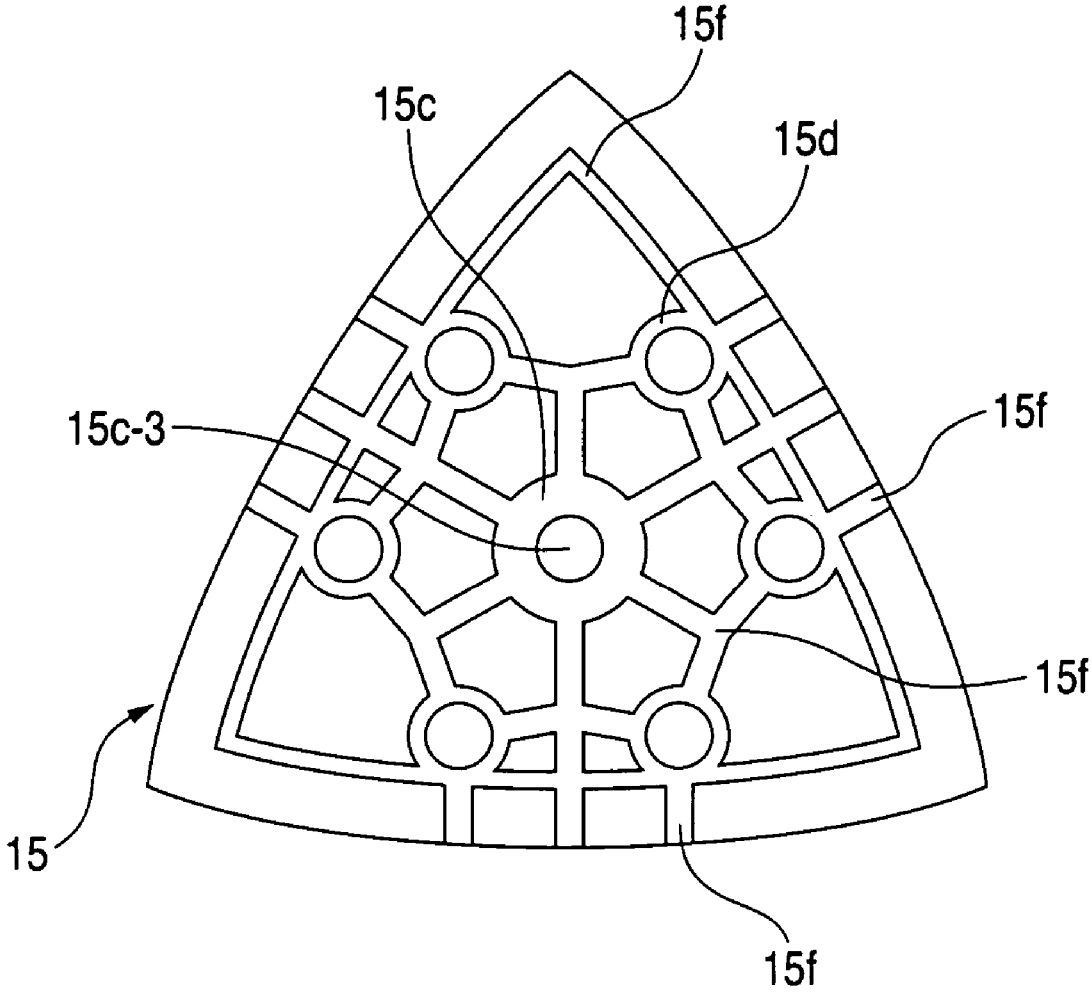
FIG. 11 is a general plain view showing an example of another abrasive substrate.

While the rotating type abrasive machine has been entirely described in the embodiments, moreover, the abrasive substrate according to the invention can also be applied to a vibration type abrasive machine. In that case, the abrasive substrate is formed such polygonal plate as a rectangular plate or a triangular plate and the rib-shaped convex projections or protrusions are formed in the central portion and the peripheral portion, thereby making the difference in a hardness. An example of another abrasive substrate is triangular plate as shown in FIG. 11. A abrasive substrate 15 shown in FIG. 11 has a shaft portion 15*c* at the center. The abrasive substrate 15 is fixed to the head portion 4 of carry type abrasive machine with a bolt which was screwed into a bolt insertion hole 15*c*-3 of the shaft portion 15*c*. Cylindrical projections 15*d* are provided around the shaft portion 15*c*. A hardness of the abrasive substrate 15 is adjusted by straight rib-shaped projections 15*f* formed on a surface of the abrasive substrate 15 with which the head portion 4 makes contact. The triangular abrasive substrate 15 is applied to a vibration type abrasive machine for carry, and especially abrades with each portion where is close to a vertex of the triangle. Therefore, the abrasive substrate 15 shown in FIG. 11 is configured such as the rib-shaped projections 15*f* which are closed to the vertex become smoothly deformed by a force exerted during abrading. A hardness of portions closed to sides of the triangle may be lower than a hardness of a center portion. Furthermore, the embodiments and the variant show the typical structures of the abrasive substrate according to the invention and are not restricted thereto. It is a matter of course that various changes can be made.

As is apparent from the above description, although the abrasive substrate which is applied to the carry type abrasive machine according to the invention includes the structure that the difference in a hardness is made between the central portion and the peripheral portion, it is manufactured by one-time molding using a single material. Consequently, a manufacturing cost can be reduced considerably as compared with the related art.

What is claimed is:

1. An abrasive substrate provided removably between an abrasive member and a head portion of a carry type abrasive machine, wherein the abrasive substrate is formed of a synthetic resin molded member which is formed by a single material, and one portion is different in hardness to another portion of surface to which the abrasive member is attached;

wherein a difference in the hardness between the central portion and the peripheral portion is regulated by a concavo-convex formed on a surface at a fixing side to the head portion of the carry type abrasive machine.

2. The abrasive substrate according to claim 1, wherein the abrasive substrate is jointed to the head portion, end a portion where is not contact with the head portion is lower than a portion where is contact with the head portion in hardness of the surface to which the abrasive member is attached.

3. The abrasive substrate according to claim 1, wherein a hardness in a peripheral portion of the abrasive substrate is lower than a hardness in a central portion excluding the peripheral portion.

4. The abrasive substrate according to claim 3, wherein the central portion has a bolt insertion hole for inserting a bolt which is used to fix the abrasive substrate to the bead portion, and projections disposed around the bolt insertion hole.

5. The abrasive substrate according to claim 1, wherein the abrasive substrate is formed by a disk.

6. The abrasive substrate according to claim 1, wherein the abrasive member is an abrasive cloth or an abrasive paper.

7. The abrasive substrate according to claim 1, wherein the concavo-convex is formed by a plurality of rib-shaped projections molded on the same plane.

8. The abrasive substrate according to claim 7, wherein the rib-shaped projections are extended radially from a support central part of the head portion of the carry type abrasive machine toward a periphery.

9. The abrasive substrate according to claim 8, wherein the rib-shaped projections are formed in a multistage from the support central part toward the periphery.

10. The abrasive substrate according to claim 7, wherein the rib-shaped projections are extended along a plurality of concentric circles around a support center of the head portion of the carry type abrasive machine.

11. The abrasive substrate according to claim 8, wherein the rib-shaped projections are extended along a plurality of concentric circles around a support center of the head portion of the carry type abrasive machine.

12. The abrasive substrate according to claim 7, wherein a height of the rib-shaped projection in the peripheral portion is set to be smaller than a height of the rib-shaped projection in the central portion.

13. The abrasive substrate according to claim 1, wherein the concavo-convex is formed by a plurality of projections having different sizes which are molded on the same plane.

14. The abrasive substrate according to claim 1, wherein a plurality of male engaging elements which enables to join to and separate from the abrasive member are integrally formed with the abrasive substrate on a surface of the abrasive substrate at a fixing side to the abrasive member.

15. The abrasive substrate according to claim 1, wherein a surface of the abrasive substrate at a fixing side for the abrasive member is rough.

* * * * *